US005385129A

United States Patent [19]

Eyberg

[11] Patent Number: 5,385,129

[45] Date of Patent: Jan. 31, 1995

[54] SYSTEM AND METHOD FOR EQUALIZING FUEL-INJECTION QUANTITIES AMONG CYLINDERS OF AN INTERNAL COMBUSTION ENGINE

[75] Inventor: Wilhelm Eyberg, Stuttgart, Germany

[73] Assignee: Robert Bosch GmbH, Stuttgart, Germany

[21] Appl. No.: 148,729

[22] Filed: Nov. 8, 1993

Related U.S. Application Data

[63] Continuation-in-part of Ser. No. 893,115, Jun. 3, 1992, abandoned.

[30] Foreign Application Priority Data

Jul. 4, 1991 [DE] Germany ..... 4122139

[51] Int. Cl.[6] ..... F02M 7/00

[52] U.S. Cl. ..... 123/436; 364/431.03

[58] Field of Search ..... 123/436, 419; 364/431.03, 431.05, 431.08, 424.1

[56] References Cited

U.S. PATENT DOCUMENTS

| | | | |
|---|---|---|---|
| 4,642,773 | 2/1987 | Miyaki et al. | 364/431.05 |
| 4,688,535 | 8/1987 | Kuttner et al. | 123/436 |
| 5,156,128 | 10/1992 | Nakagawa | 123/436 |
| 5,239,473 | 8/1993 | Ribbens et al. | 364/431.08 |
| 5,265,575 | 11/1993 | Norota | 123/436 |
| 5,278,760 | 1/1994 | Ribbens et al. | 364/424.1 |

*Primary Examiner*—Raymond A. Nelli
*Attorney, Agent, or Firm*—Kenyon & Kenyon

[57] ABSTRACT

In a system and method for equalizing fuel-injection quantities among cylinders of an internal combustion engine, angular acceleration is measured during the combustion process of each cylinder of the internal combustion engine. The individual measured values of the angular acceleration are compared to one another. In case of deviations between the individual measured values, the fuel-injection quantity is altered in a way that allows for the deviations to be compensated.

20 Claims, 4 Drawing Sheets

SYSTEM AND METHOD FOR EQUALIZING FUEL-INJECTION QUANTITIES AMONG CYLINDERS OF AN INTERNAL COMBUSTION ENGINE

CROSS-REFERENCE TO RELATED APPLICATION

This application is a continuation-in-part of pending U.S. application Ser. No. 07/893,115, filed on Jun. 3, 1992.

FIELD OF THE INVENTION

The present invention relates to a method for equalizing fuel-injection quantities among cylinders of an internal combustion engine.

BACKGROUND OF THE INVENTION

When an internal combustion engine is running, rotational irregularities occur because varying quantities of fuel are injected into the individual cylinders of the internal combustion engine. Tolerances of the individual injection components are significant. In motor vehicles, for example, the resulting rotational irregularities can cause vibrations. These tolerances can be reduced only by expending a considerable amount of time and energy.

Means for controlling the running smoothness of an internal combustion engine, which are used to reduce vibrations produced as a result of variations in the quantity of injected fuel, are known. It is known, for example, to determine the amount by which the rotational speed of individual cylinders deviates from the average rotational speed of the internal combustion engine. However, such a means for controlling the running smoothness of an internal combustion engine is able to be optimized only for a limited rotational-speed range, and, thus, the vibrations can be compensated for only in a limited rotational-speed range.

SUMMARY OF THE INVENTION

According to a method of the present invention, as a result of the structure of a PT1-circuit, the rotational irregularities of an internal combustion engine due to varying quantities of injected fuel are able to be avoided over virtually the entire operating range of the engine.

The method of the present invention is based on measuring the angular acceleration of each combustion process. The measured values are compared to one another and deviations are established. On the basis of the deviations, the fuel-injection quantities of the individual cylinders are altered in a way that ultimately allows deviations to be avoided. Consequently, rotational irregularities of the internal combustion engine based on this phenomenon are eliminated.

In an embodiment of the method according to the present invention, the mean (average) value of the measured angular acceleration values is determined as a sliding average over all cylinders. In this manner, the fuel-injection quantities can also be adjusted when the engine is experiencing non-steady operating conditions.

In another embodiment of the method according to the present invention, when a measured angular acceleration value deviates from the average value of the angular acceleration, an additional injection quantity is fed to the corresponding cylinder in one of the subsequent injection processes. Preferably, the correction is made in the next injection process.

In yet another embodiment of the method according to the present invention, the average value is determined from the sum of the additional, individual injection quantities and subtracted from all additional injection quantities. Even when there are sudden changes in the average angular acceleration, this compensation keeps the average value of the compensation quantities approximately at zero. Consequently, a deviation from the average injection quantity affects the preselected value of the injection quantities. In this manner, a "drifting" of the compensation quantities is avoided.

DETAILED DESCRIPTION

Figure 1:
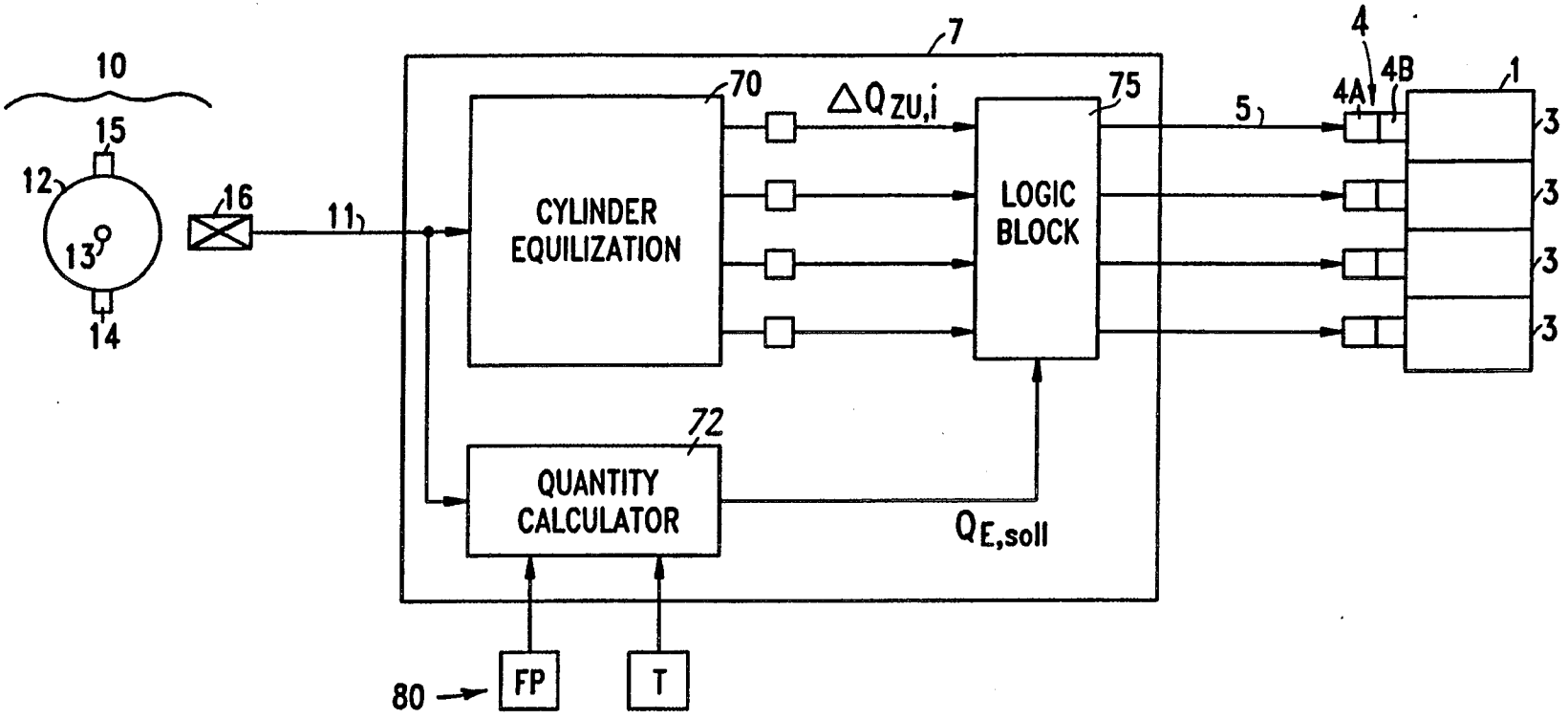
FIG. 1 shows a functional block diagram of an internal combustion engine having a controlling means for carrying out the method of the present invention.

FIG. 1 shows a functional circuit of an internal combustion engine 1 having a control unit 7. The internal combustion engine 1 has four cylinders 3. A fuel-metering device 4 is preferably allocated to each cylinder. The fuel-metering device 4 may be comprised of a solenoid valve 4*a* and a-pump element 4*b*. Each solenoid valve 4*a* is linked via a control line 5 to the control unit 7.

Alternatively, one can have a single fuel-metering device 4, which sequentially charges the individual cylinders with fuel. Such a device is illustrated in Miyaki et al U.S. Pat. No. 4,642,773 which is hereby incorporated by reference. In such a system, the trigger signals are transmitted one after another over a single line 5. Such a fuel-metering device is usually referred to as a distributor pump.

The present invention is not limited to applications involving a solenoid-valve-controlled fuel-metering device. For example, the present invention can also be used in conjunction with conventional fuel pumps. In such an embodiment, the quantity of fuel that is injected is adjusted by means of a control rod (in the case of in-line injection pumps) or an adjusting lever (in the case of distributor injection pumps).

The control unit 7 evaluates signals from a sensor which is coupled to the control unit 7 via a supply line 11. The sensor 10, which is commonly referred to as a speed sensor, includes a disk 12, which is mounted on a crankshaft 13 of the engine 1. Two markings 14 and 15 are provided on the disk 12 for a four cylinder engine. Such a configuration is also known as a segmented wheel.

A detector 16, which comprises an electromagnetic sensing element (not shown), senses the segmental wheel. As the disk 12 rotates synchronously with the crankshaft, the detector 16 emits a signal every time it detects a marking (14, 15) on the disk 12. The detector 16 may comprise inductively working proximity switches. The signal emitted by the detector 16 is received at the control unit via line 11.

Alternatively, a segmental wheel can be mounted on the camshaft of the engine 1. Since for every engine revolution, the crankshaft turns twice and the camshaft only once, four markings are needed for a segmental wheel mounted on the camshaft.

In accordance with another embodiment of the present invention, an incremental wheel is mounted on the camshaft or on the crankshaft. The incremental wheel has K * Z markings where Z is the number of cylinders and K a natural number greater than 1. In this case, only every K-th pulse is evaluated.

All of these embodiments provide a detector applying Z-pulses per engine revolution to the control unit 7. Thus, four pulses occur per engine revolution in the described specific embodiment having four cylinders. The markings are arranged so as to allow the individual markings to be equally spaced apart given a uniform engine revolution. These pulses are used to calculate the rotational speed and angular acceleration with respect to each cylinder as explained more fully below.

The quantity calculator 72 processes the signals from various sensors 80 including the speed sensor. On the basis of the gas pedal position, the rotational speed and other operating parameters, such as temperature, the quantity calculator 72 determines an average injection quantity $Q_{E,So11}$. This injection quantity is required to provide the driver with the desired driving performance.

On the basis of different effects, the individual cylinders contribute to varying degrees to the total torque. To compensate for this, the cylinder equalization 70 calculates correction values $Q_{Zu,i}$ for the individual cylinders. These are preferably determined after metering into cylinder i and during the next metering into cylinder i. For this purpose, the correction values are filed in the storage means 74 for each cylinders. The cylinder equalization 70 could include, for example, a microprocessor or sequencer programmed to implement the steps of FIG. 4 as discussed below.

The logic block 75 combines the average injection quantity and the correction quantity for the individual cylinders. Preferably, both values are added. The fuel-metering devices 7 receive this corrected signal.

The fuel-metering device 4 functions as follows. An up-and-down moving piston pressurizes the fuel in an element chamber. If the pressure of the fuel reaches a preselected value, then an injection valve (not shown) opens. If the pressure falls below a threshold value, then the injection ends. At this point, the pressure can be controlled by providing a solenoid valve, which connects the element chamber to a low-pressure chamber.

By convention, the solenoid valve is open when in the flow-through state and closed when in the non-flow-through state. To control the metering, at the instant the injection is supposed to take place, the solenoid valve closes. From this instant on, a pressure build-up is possible, and the injection begins.

At the instant in which the injection is supposed to end, the solenoid valve is traversed by flow. This causes it to open, and the pressure prevailing in the element chamber falls off, and the injection ends. The length of the time period in which the solenoid valve is not traversed by flow (i.e. closed) thus determines the duration of injection and, consequently, the injected fuel quantity.

Therefore, a pulse-shaped signal, which causes the solenoid valve to be triggered accordingly, is transmitted via line 5. The length of the pulse-shaped signal thereby determines the injected fuel quantity.

In this type of fuel-metering device, the average injection quantity $Q_{E,So11}$ corresponds to an average triggering duration. The correction values $Q_{Zu,i}$ correspond to a correction time, which is added to the average triggering duration, to obtain the triggering duration for the specific cylinder.

Figure 2:
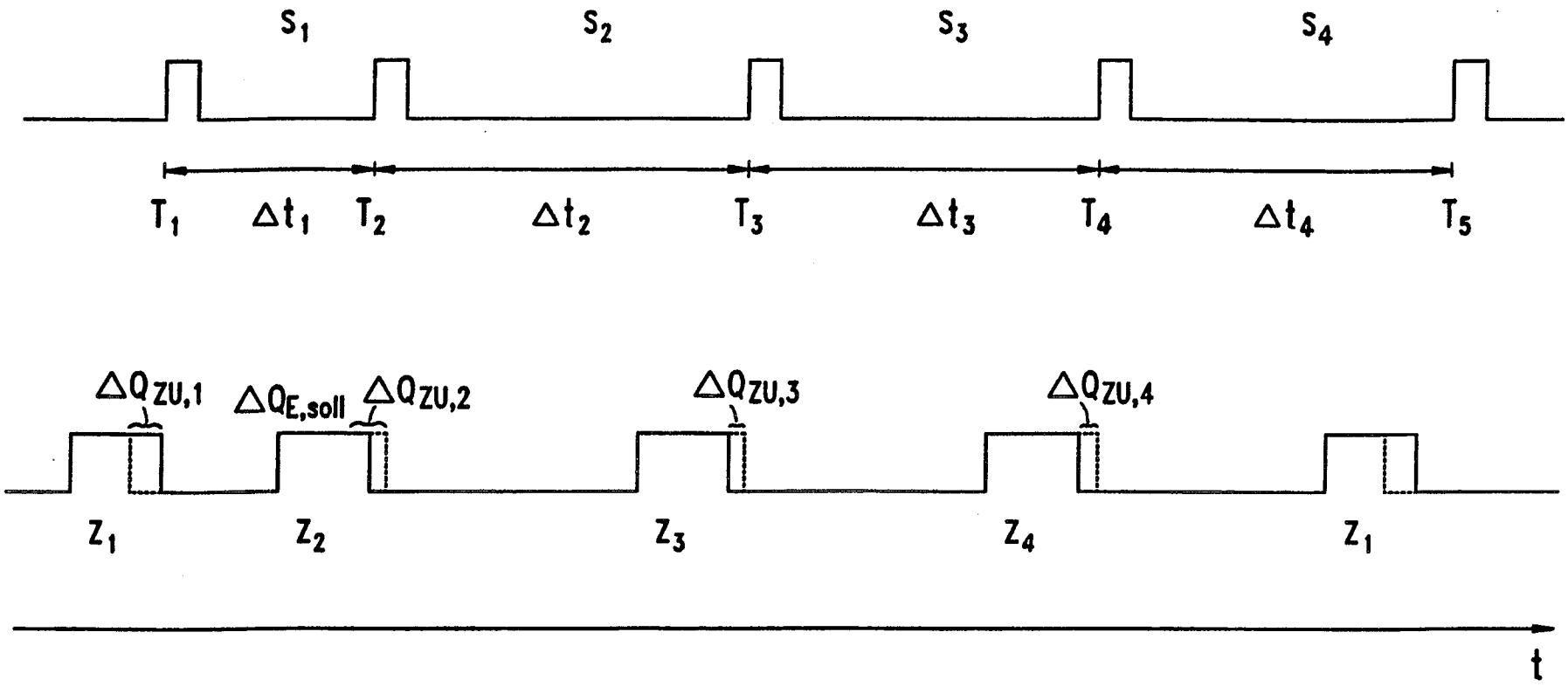
FIG. 2 shows the output signal from the sensor of FIG. 1.

Referring to FIG. 2, the output signal from sensor 16 is plotted over time. Every time one of the two marks 15 or 14 is rotated past, the sensor generates a pulse-shaped signal at its output. Two signals at a time define one segment ($S_i$). The positive edge of the first pulse follows at instant T1, that of the second pulse at instant T2, that of the third pulse at the instant T3, that of the fourth pulse at instant T4, and that of the fifth pulse at instant T5.

Similar (positive or negative) edges of two successive pulses define one segment at a time. Segment S1 is defined by instants T1 and T2; segment S2 by instants T2 and T3; segment S3 by instants T3 and T4; and segment S4 by instants T4 and T5.

The time interval between instants T1 and T2 (the segment duration for segment $S_1$) is denoted by t1; the period of time between instants T2 and T3 as t2; the period of time between instants T3 and T4 as t3; and the period of time between instants T4 and T5 as t4. These time spans $t_i$ are described as width of the segments $S_i$ or as run-through time. Based on these times $t_i$, one obtains the instantaneous speeds $N_i$ in accordance with equation 3.1*a* infra. The segments $S_i$, the time spans $t_i$, and the instantaneous speeds $N_i$ are allocated in each case to the i-th cylinder.

In the second line of the second Figure, the pulse-shaped signal, which is transmitted via line 5 and corresponds to the trigger pulses for the solenoid valves 4*a* of the various cylinders Z1, Z2, Z3 and Z4, is plotted over time. In each case, the segment $S_i$ following the metering into the i-th cylinder Zi is allocated to the i-th cylinder. In the illustration of FIG. 2, the first cylinder allocated to the first segment $S_1$ contributes more to the total torque than do the remaining cylinders.

An appropriate correction fuel quantity $Q_{zu,i}$ is calculated for each cylinder. In the illustrative embodiment including a solenoid-valve-controlled fuel-metering device, this means that the injection duration is shortened or prolonged accordingly.

The trigger duration, which corresponds to the average injected fuel quantity $Q_{E,So11}$, is plotted with a solid line. The trigger durations, which correspond to the fuel quantities actually injected that result when the individual correction quantities are considered, are plotted with a dotted line. The metering duration allocated to the first cylinder is shortened; and the others prolonged accordingly.

In the case of fuel-metering devices having a control rod or an adjusting lever, the trigger duration corresponds to a current value for a positioning unit for adjusting the control rod or the adjusting lever. In this case, the current values are increased or reduced accordingly.

The manner in which the fuel injection quantity is determined in accordance with the present invention will now be explained. Because of deviations in the quantities of fuel injected into the cylinders 3 of the internal combustion engine 1 shown in FIG. 1, varying cylinder pressure values result during combustion. Consequently, the accelerating torques based on the combustion also deviate from one another. The correlation between the engine torque M and the rotational speed n is given by the following expression:

$$n = \int n\,dt = \int \frac{M_B - M_L}{\theta_{ges}}\,dt \tag{2.1}$$

In this expression, $M_B$ denotes the accelerating torque, $M_L$ the load torque, and $\theta_{ges}$ the mass moment of inertia of the crankshaft.

When the effects of efficiency factors, as well as the influence of the crankshaft angle, are disregarded, the accelerating torque $M_B$ is proportional to the injected fuel mass, so that the following expression results:

$$M_B = c.\overline{Q_E}$$

In this expression, $Q_E$ denotes the average quantity of fuel delivered per power stroke, and c denotes a constant. At steady-state working points of the engine, the accelerating torque $M_B$ conforms to the load torque $M_L$, so that the following expression results for the average quantity of fuel delivered per power stroke:

$$\overline{Q_E} = M_L/C \tag{2.2}$$

If the quantity of fuel delivered to a cylinder m deviates by the amount A $Q_{E,m}$ from the average fuel quantity, the following expressions result for the individual fuel delivery quantities $Q_{E,i}$, where $Q_{E,i}$ is the individual fuel delivery quantity to cylinder "i", and where z represents the number of cylinders of the internal combustion engine:

$$Q_{E,i} = \overline{Q_E} - \frac{\Delta Q_{E,m}}{z-1} \text{ for } i > m \text{ and } i < m \tag{2.3a}$$

$$Q_{E,i} = \overline{Q_E} + \Delta Q_{E,m} \text{ for } i = m \tag{2.3b}$$

From the above-mentioned equations, the following expressions result for the active, accelerating torques $M_B$ for the individual cylinders:

$$M_{B,i} = c \cdot \frac{\overline{Q_E} - \Delta Q_{E,m}/z - 1}{\theta_{ges}} \text{ for } i > m \text{ and for } i < m \tag{2.4a}$$

$$M_{B,i} = c \cdot \frac{\overline{Q_E} + \Delta Q_{E,m}}{\theta_{ges}} \text{ for } i = m \tag{2.4b}$$

From expressions (2.2) and (2.4a/2.4b), the correlation between angular accelerations for each cylinder, averaged over one power stroke, and the injection quantities is obtained for steady-state engine working points based upon the following expressions:

$$\dot{n}_i = \frac{c \cdot \left(\overline{Q_E} - \frac{\Delta Q_{E,m}}{z-1}\right) - M_L}{\theta_{ges}} \text{ for } i = m \tag{2.5a}$$

$$\dot{n}_i = \frac{-c}{\theta_{ges}} \cdot \frac{\Delta Q_{E,m}}{z-1} \text{ for } i > m \text{ and for } i < m \tag{2.5b}$$

From these expressions, the following expression results for a cylinder m:

$$\dot{n}_m = \frac{c \cdot \Delta Q_{E,m}}{\theta_{ges}}$$

Figure 3:
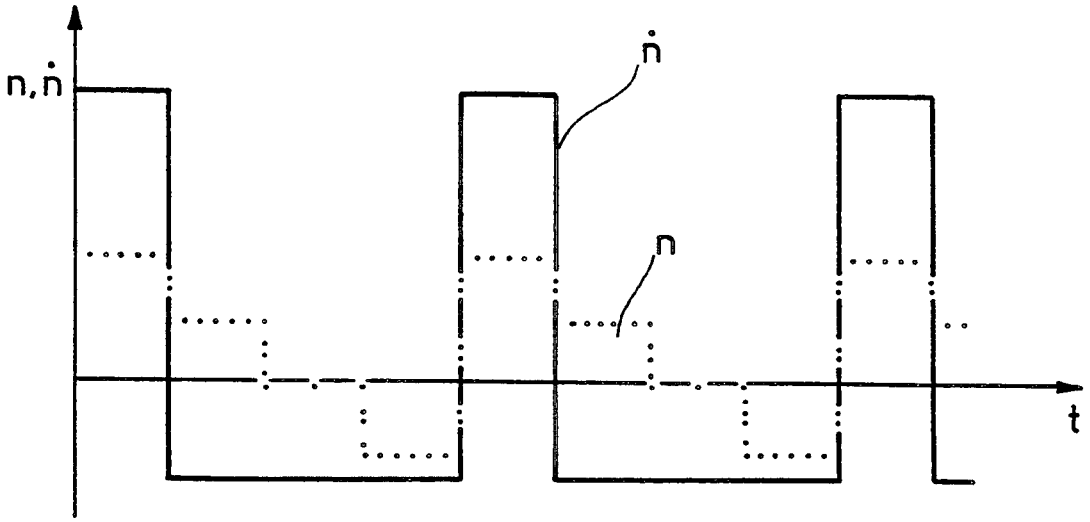
FIG. 3 shows a graph of the rotational speed and angular acceleration of a four-cylinder internal combustion engine as a function of time.

These expressions produce the graph shown in FIG. 3 of rotational speed n and angular acceleration n as a function of time, for an internal combustion engine with four cylinders, for example, where the plotted values are averaged over one cylinder.

At a constant average rotational speed, i.e., in the "steady-state" situation, the average angular acceleration is calculated over z power strokes according to the following expressions:

$$\bar{\dot{n}} = \frac{1}{z} \sum_{i-1}^{z} \dot{n}_i$$

$$\bar{\dot{n}} = \frac{c}{z \cdot \theta_{ges}} \cdot \left(-(z-1) \cdot \frac{\Delta Q_{E,m}}{z-1} + \Delta Q_{E,m}\right) \tag{2.6}$$

$$\bar{\dot{n}} = 0$$

In the "non-steady-state" situation, i.e., when the average value of the accelerating torque $M_B$ is less than or greater than the load torque $M_L$, the average value of the individual accelerations per power stroke is determined according to the following expressions:

$$\bar{\dot{n}} = \frac{1}{z \cdot \theta_{ges}} \cdot \left[(z-1) \cdot \left(c \cdot \left(\overline{Q_E} - \frac{\Delta Q_{E,m}}{z-1}\right) - M_L\right) + (c \cdot (\overline{Q_E} + \Delta Q_{E,m}) - M_L)\right] \frac{\Delta Q_{E,m}}{z-1} \tag{2.7a}$$

From this expression, the following expression is obtained:

$$n = \frac{1}{z \cdot \theta_{ges}} \cdot \left[((z-1) \cdot (c \cdot Q_E - M_L) + c \cdot Q_E - M_L) + \left(-(z-1) \cdot c \cdot \frac{\Delta Q_{E,M}}{z-1} + c \cdot Q_{E,L}\right)\right] \tag{2.7b}$$

This expression can be further simplified as follows:

$$\bar{\dot{n}} = \frac{1}{z \cdot \theta_{ges}} \cdot [z \cdot (c \cdot \overline{Q_E} - M_L + O] \tag{2.7c}$$

Finally, the following expression results:

$$\bar{\dot{n}} = \frac{c \cdot \overline{QE} - M_L}{\theta_{ges}} \tag{2.7d}$$

From the two systems of equations (2.6) and (2.7), it is apparent, with the method according to the present invention, that it is possible to determine the injection quantities fluctuating from cylinder to cylinder, and, thus, the systematic dispersions of the injection quantities, for non-steady-state working points as well. For achieving this purpose, the "average angular acceleration", that is, the angular acceleration according to expression (2.6) averaged over z power strokes, is subtracted from the "instantaneous value" of the angular acceleration, and thus from the angular acceleration according to expression (2.5) averaged over one power stroke. If fluctuation in the rotation of the internal combustion engine is assumed to be due only to the supply of deviating injection quantities to the individual cylinders, the deviations in the injection quantities can be calculated through approximation from the following expression:

$$\Delta Q_{E,i} = \frac{\theta_{ges}}{c} \cdot (\dot{n}_i - \bar{\dot{n}}) \tag{2.8a}$$

In this expression, n is determined by the following expression:

$$\bar{\dot{n}} = \frac{1}{z} \sum_{i=1}^{z} \dot{n}_i \tag{2.8b}$$

Using the relationships described above, the method according to the present invention for equalizing fuel-injection quantities among the cylinders shall now be described in greater detail with reference to FIG. 4.

First, the rotational speed of the internal combustion engine is measured by using the fact that one electrical pulse is generated for each power stroke of the internal combustion engine. For this purpose, a pulse wheel can be used, for example, the output signal of which is evaluated in a speed sensor as previously discussed.

For the following discussions, the assumption is made that the internal combustion engine operates according to the four-stroke method and that the firing intervals are constant. Moreover, it is assumed that for each power stroke, exactly one speed pulse is generated, the position of which is unchanged with respect to the top dead center of a cylinder.

Figure 4:
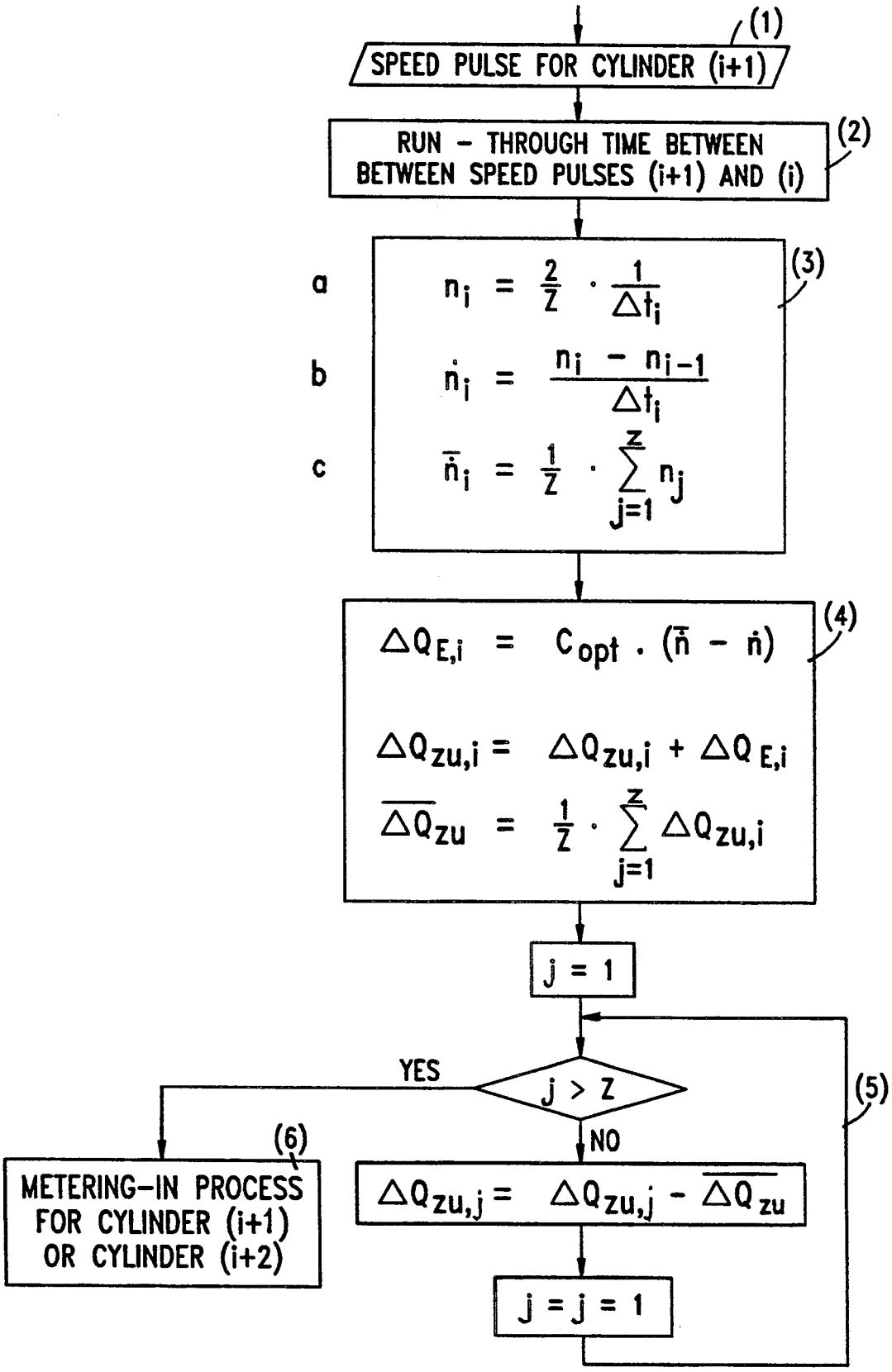
FIG. 4 shows a flow chart according to the method of the present invention for determining the angular acceleration values and for equalizing fuel-injection quantities among the cylinders of an internal combustion engine.

Step 1 of the flow chart shown in FIG. 4 involves the generation and detection of the speed pulse for cylinder $(i+1)$. Step 2 of the flow chart 3 determines the run-through time $\Delta t_i$ between two speed pulses allocated to cylinders $(i+1)$ and (i). From the time $\Delta t_i$ which ends between two successive pulses, the instantaneous rotational speed $n_i$ is determined according to the following expression:

$$n_i = \frac{2}{z} \cdot \frac{1}{\Delta t_i} \tag{3.1a}$$

From this expression, the average angular acceleration $n_i$ between two power strokes can be calculated through use of the following expression:

$$\dot{n}_i = \frac{\Delta n}{\Delta t} = \frac{n_i - n_{i-1}}{\Delta t_i} \tag{3.1b}$$

For example, if the derivative of the rotational speed, and, thus, the angular acceleration in segment S2, is to be calculated, then according to expression (3.1*b*), the difference between the rotational speed $n_1$ in segment S1 and the rotational speed $n_2$ in segment S2 is divided by the width $\Delta t_2$ of the segment S2. This type of calculation is necessary because the rotational speed can be measured only over one segment and not at a specific instant.

Step 3 of the flow chart in FIG. 4 performs the calculations contained in expressions (3.1*a*) and (3.1*b*). Finally, in the third step at "c," the average value of the angular acceleration is determined in accordance with expression (2.8*b*).

To eliminate rotational irregularities due to varying fuel injection quantities, it should be emphasized that the varying fuel quantities can be due to the existence of either varying delivery rates at a constant duration of delivery or varying durations of delivery at constant delivery rates. Also, a combination of these conditions can exist.

For the sake of simplicity, it is assumed in the following discussion that an efficiency factor is constant and that the influence of the crank angle is negligible. Under these conditions, it can be assumed that the angular acceleration is directly proportional to the injected fuel quantity.

Consequently, the following relationship is established for the injected fuel quantities: in case deviates the angular acceleration caused by one cylinder from the average angular acceleration, an additional injection quantity $\Delta Q_{e,i}$, which is proportional to this deviation, is supplied during the next injection for compensation purposes. The additional injection quantity is calculated according to the following expression:

$$\Delta Q_{E,i} = C_{Opt} \cdot (\bar{\dot{n}} - \dot{n}_i) \tag{4.1}$$

In this expression, $\Delta Q_{e,i}$ denotes the additional fuel quantity to be supplied to the cylinder i, n denotes the average angular acceleration over two crankshaft revolutions, $n_i$ denotes the angular acceleration caused by the cylinder i, and $C_{Opt}$ denotes a constant. The individual additional fuel quantities to be supplied are continuously added while the method described herein is carried out. The sum is denoted by $\Delta Q_{zu,i}$ and results from the following expression:

$$\Delta Q_{zu,i} = \sum_{j=1}^{\infty} \Delta Q_{E,i} \tag{4.2}$$

A comparison of expression (4.1) to expression (2.8*a*) shows that the constant $C_{Opt}$ is selected dependent upon the mass moment of inertia of the engine.

A comparison of expressions (4.1) and (4.2) to expression (2.5*c*) shows that the calculation of the compensation quantities exhibits a PT1 action. From expressions (4.1), (2.5*c*) and (2.2), it can be shown that in the ideal case the constant $C_{Opt}$ is as follows:

$$C_{Opt} = \frac{\theta_{ges}}{C} = \theta_{ges} \cdot \frac{Q_E}{M_B}$$

This design compensates for a rotational irregularity with the first calculation of the corresponding compensation quantity. The prerequisite, however, is the validity of the linearization of the correlation between the injection quantity and the generated moment of rotation.

In any case, the following condition applies:

$$C_{Opt} < 2 \cdot \theta_{ges} \cdot Q_E / M_B$$

This condition marks the stability limitation. If the expression is exceeded, the result is compensation quantities which cause the same or greater rotational irregularities with an opposite sign at the next injection process.

The determination of the additional injection quantity $\Delta Q_{E,i}$ which equalizes the fuel-injection quantities among the cylinders is performed in step 4 of the flow chart shown in FIG. 4, where expression (4.1) appears in the first line. The summing of the compensation quantities follows in the second sub-step of the fourth step of the flow chart shown in FIG. 4. Finally, a mean value is generated in the third sub-step.

All of the added compensation quantities $\Delta Q_{zu,i}$ are compensated for relative to this mean value (compare step 5 of the flow chart shown in FIG. 4):

$$\overline{\Delta Q_{zu}} = \sum_{K=1}^{z} \Delta Q_{zu,K} \tag{4.3a}$$

$$\Delta Q_{zu,j} = \Delta Q_{zu,j} - \Delta Q_{zu} \text{ for } j = 1 \ldots z \tag{4.3b}$$

This "coupling condition" prevents a "drifting" of the compensation quantities, and ensures that the actual average injection quantity is equal to the desired preselected quantity over all of the cylinders.

Instead of using the coupling condition of expressions (4.3*a*) and (4.3*b*), it is possible to calculate the compensation quantities $\Delta Q_{zu}$ corresponding to expression (4.3*b*) with each determination of the additional injection quantity $\Delta Q_{E,i}$ in accordance with expression (4.1) as follows:

$$\Delta Q_{zu,i} = \Delta Q_{zu,i} + \Delta Q_{E,i} \tag{4.4a}$$

$$\Delta Q_{zu,j} = \Delta Q_{zu,j} - \frac{1}{Z-1} \cdot \Delta Q_{E,i} \tag{4.4b}$$

$$\text{for } j = 1 \ldots Z \text{ and } j = i$$

The additional injection quantity for a particular cylinder i determined by performing the steps set forth above is added to the average injection quantity, which is determined by a value $Q_{E,So11}$. This value is determined by means of the gas pedal, for example. Consequently, the individual value of the injection quantity $Q_{So11,i}$ of cylinder i can be calculated from the following expression:

$$Q_{So11,i} = Q_{E,So11} + \Delta Q_{zu,i} \tag{4.5}$$

In addition to the two methods discussed above, it is also possible to perform the compensation with respect to the average value of the compensation quantities in the following manner: First, one of the cylinders of the internal combustion engine is chosen and designated by k. Then, the compensation quantity for the cylinder is calculated according to the following expression:

$$\Delta Q_{zu,k} = -\sum_{i=1}^{z} Q_{zu,i} \text{ for } i > k \text{ and } i < k$$

For all of the cylinders in which i is not equal to k, the calculation of $\Delta Q_{zu,i}$ is performed in accordance with expressions (4.1) and (4.2).

From the above discussions, and in particular from the flow chart shown in FIG. 4, it is apparent that the calculation of the additional injection quantity is preferably concluded before the next fuel metering process takes place. The reason for this is that whenever the coupling condition of expression (4.4) is considered, the compensation quantity is influenced. The compensation quantity must be considered with the next fuel metering for a cylinder.

This follows from the fact that after the occurrence of a speed pulse for cylinder i, the following process steps must be performed: First, the value $\Delta Q_{zu,i}$ must be calculated in accordance with expressions (4.2) and (4.3), or expression (4.4). Thereafter, the fuel metering for cylinder $(i+1)$ occurs, and the fuel delivery is activated. At that point, combustion can begin in cylinder $(i+1)$.

If the time required for the fuel metering is not considered, the compensation quantities $\Delta Q_{zu,i}$ actually delivered can have an average value that differs from zero, in spite of the coupling condition of expression (4.4).

This method of satisfying the coupling condition, in which a single cylinder k renders the sum of the compensation quantities equal to zero, has the disadvantage that the coupling condition is met only at every two revolutions of the crankshaft. As a result, the transient recovery times for a method performed in this manner increase only slightly as compared to the two other methods of satisfying the coupling condition.

When integral arithmetic is applied, rounding errors in the average value of the compensation quantities at the second digit position can occur as a result of calculating the value $\Delta Q_{E,i}/(z-1)$. These rounding errors ultimately cause the average value to vary from zero.

As illustrated in step 5 of FIG. 4, after each recalculation of a compensation quantity $\Delta Q_{zu,i}$, the average value of all of the compensation quantities of the cylinders can be calculated and subtracted from each of the compensation quantities.

Considering the numerous, successive steps which must be performed for cylinder i after the occurrence of a speed pulse, and the mass moment of inertia of the final control elements triggered in this method, it may be necessary to have an interval between the speed pulse and the top dead center which is too great. In this case, the injected fuel quantity for one cylinder may no longer be compensated for in the next metering-in process. Step 6 of the flow chart shown in FIG. 4 illustrates that the metering-in process can possibly be performed only for cylinder $(i+2)$, and not for cylinder $(i+1)$.

The method described above for adaptively equalizing injected fuel with respect to the individual cylinders provides a considerable reduction in the amount of time and energy expended in order to adjust and compensate an injection system. The method is applicable over the entire operating range of the engine, including nonsteady operating states of the engine.

Finally, when adding or integrating the individual values, it is also possible for extreme values to be determined separately, in order to record errors in the overall system. Therefore, this method can also be used to diagnose an internal combustion engine.

The terms and expressions which are employed herein are used as terms of expression and not of limitation. And, there is no intention, in the use of such terms and expressions, of excluding the equivalents of the features shown, and described, or portions thereof, it being recognized that various modifications are possible within the scope of the present invention.

What is claimed is:

1. A system for equalizing fuel-injection quantities among cylinders of an internal combustion engine of a vehicle, comprising:

a fuel metering device for injecting a quantity of fuel into each cylinder of the engine;

a controller coupled to the fuel metering device;

the controller determining an angular acceleration of at least one of a crankshaft and camshaft of the vehicle during a combustion process at each cylinder;

the controller comparing the determined angular accelerations to detect a deviation between at least two determined angular accelerations; and the controller controlling the fuel metering device to alter the quantity of fuel injected into one or more of the cylinders of the engine in order to compensate for a deviation, if such a deviation is detected.

2. The system as recited in claim 1, wherein the controller determines a rotational speed at each of a first and second segment of a segmented wheel, determines a difference between the rotational speeds, determines a run-through time of a third and fourth segment of the segmented wheel, and divides the difference by the run-through time to determine the angular accelerations.

3. The system as recited in claim 1, wherein the controller further determines an average value of the angular accelerations.

4. The system as recited in claim 3, wherein the average value is determined as a sliding average over all of the cylinders of the engine.

5. The system as recited in claim 3, wherein the controller further compares each of the angular accelerations to the average value to determine a deviating angular acceleration, and controls the fuel metering device to inject an additional fuel quantity into the cylinder corresponding to the deviating angular acceleration during a subsequent fuel injection process.

6. The system as recited in claim 5, wherein the subsequent fuel injection process is the next fuel injection process.

7. The system as recited in claim 5, wherein the additional fuel quantity is proportional to a difference between the deviating angular acceleration and the average value.

8. The system as recited in claim 5, wherein the controller continuously compares the angular accelerations to the average value, and controls the fuel metering device to inject a plurality of additional fuel quantities.

9. The system as recited in claim 8, wherein the controller continuously adds the additional fuel quantities to form a cumulative value for each cylinder.

10. The system as recited in claim 9, wherein the cumulative value is equal to zero.

11. A method of equalizing fuel-injection quantities among cylinders of an internal combustion engine of a vehicle, comprising the steps of:

determining an angular acceleration of at least one of a crankshaft and camshaft of the vehicle during a combustion process at each cylinder;

comparing the determined angular accelerations to detect a deviation between at least two determined angular accelerations; and controlling a fuel metering device to alter the quantity of fuel injected by the fuel metering device into one or more of the cylinders of the engine in order to compensate for a deviation, if such a deviation is detected.

12. The method as recited in claim 11, wherein the method further comprises the steps of:

determining a rotational speed at each of a first and second segment of a segmented wheel;

determining a difference between the rotational speeds;

determining a run-through time of a third and fourth segment of the segmented wheel; and dividing the difference by the run-through time to determine the angular accelerations.

13. The method as recited in claim 11, wherein the method further comprises the step of determining an average value of the angular accelerations.

14. The method as recited in claim 13, wherein the average value is determined as a sliding average over all of the cylinders of the engine.

15. The method as recited in claim 13, wherein the method further comprises the steps of:

comparing each of the angular accelerations to the average value to determine a deviating angular acceleration; and injecting an additional fuel quantity into the cylinder corresponding to the deviating angular acceleration during a subsequent fuel injection process.

16. The method as recited in claim 15, wherein the subsequent fuel injection process is the next fuel injection process.

17. The method as recited in claim 15, wherein the additional fuel quantity is proportional to a difference between the deviating angular acceleration and the average value.

18. The method as recited in claim 15, wherein the angular accelerations are continuously compared to the average value, and a plurality of additional fuel quantities are injected.

19. The method as recited in claim 18, wherein the method further comprises the step of continuously adding the additional fuel quantities to form a cumulative value for each cylinder.

20. The method as recited in claim 19, wherein the cumulative value is equal to zero.

* * * * *